United States Patent [19]

Kenworthy

[11] 4,184,925

[45] Jan. 22, 1980

[54] SOLID METAL ORIFICE PLATE FOR A JET DROP RECORDER

[75] Inventor: E. J. Doyle Kenworthy, Dayton, Ohio

[73] Assignee: The Mead Corporation, Dayton, Ohio

[21] Appl. No.: 861,852

[22] Filed: Dec. 19, 1977

[51] Int. Cl.[2] ..... C25D 1/08; C25D 1/02

[52] U.S. Cl. ..... 204/11; 204/9

[58] Field of Search ..... 204/11, 9

[56] References Cited

U.S. PATENT DOCUMENTS

| | | | |
|---|---|---|---|
| 2,123,297 | 7/1938 | Beynen et al. | 204/6 |
| 2,166,367 | 7/1939 | Norris | 204/6 |
| 2,225,733 | 12/1940 | Beebe | 204/11 |
| 2,598,318 | 5/1952 | Teal | 204/24 |
| 2,702,270 | 2/1955 | Donahue et al. | 204/11 |
| 3,190,778 | 6/1965 | Dahlberg | 156/62 |
| 3,402,110 | 9/1968 | Scherrer | 204/11 |
| 3,461,045 | 8/1969 | Franks | 346/75 |
| 3,577,198 | 5/1971 | Beam | 346/75 |
| 3,582,476 | 6/1971 | Knisley | 204/11 |
| 3,701,476 | 10/1972 | Houser | 239/102 |
| 3,701,998 | 10/1972 | Mathis | 346/75 |
| 3,703,450 | 11/1972 | Bakewell | 204/11 |
| 3,709,432 | 1/1973 | Robertson | 239/4 |
| 3,726,770 | 4/1973 | Futterer | 204/11 |
| 3,739,393 | 6/1973 | Lyon et al. | 346/1 |
| 3,803,688 | 4/1974 | Peck | 29/157.3 R |
| 3,882,508 | 5/1975 | Stoneburner | 346/75 |
| 3,921,916 | 11/1975 | Bassous | 239/601 |
| 3,949,410 | 4/1976 | Bassous et al. | 346/75 |
| 3,958,249 | 5/1976 | De Maine et al. | 346/75 |
| 3,970,222 | 7/1976 | Duffield | 222/148 |
| 4,007,464 | 2/1977 | Bassous et al. | 346/75 |
| 4,031,561 | 6/1977 | Paranjpe | 346/1 |
| 4,039,397 | 8/1977 | Klemm | 204/11 |
| 4,080,267 | 3/1978 | Castellani et al. | 204/11 |

OTHER PUBLICATIONS

IBM Tech. Disclosure Bulletin, vol. 18, Oct. 1975, p. 1342.

*Primary Examiner*—T. M. Tufariello

*Attorney, Agent, or Firm*—Biebel, French & Nauman

[57] ABSTRACT

An orifice plate for a jet drop recorder is fabricated by plating techniques. It is formed throughout of a single, homogeneous material, such as nickel, for compatibility with the recorder ink, and is of sufficient thickness to provide adequate strength. The orifices are open on both sides for easy cleaning.

7 Claims, 7 Drawing Figures

SOLID METAL ORIFICE PLATE FOR A JET DROP RECORDER

BACKGROUND OF THE INVENTION

This invention relates to jet drop recorders of the general type disclosed in U.S. Pat. Nos. 3,577,198, 3,701,476, 3,701,998, 3,709,432, 3,739,393, 3,882,508, 3,970,222 and 4,031,561, all assigned to the assignee of the present invention. Such jet drop recorders comprise a series of electric and fluidic components, including an orifice plate and a charge plate, for generating one or more rows of jets of ink and selectively charging the ink droplets as they form from the jets. Typically there may be several hundred jets formed in each such row, and each jet may be stimulated to produce drops of ink at a rate of about 400 kHz. All such drops fall through an electrical deflection field, and those which are charged are deflected into a catcher. Uncharged drops are deposited on a moving web transported below the recording head.

One of the critical requirements in such a jet drop recorder is an orifice plate which will produce several hundred jets of ink which are precisely positioned, precisely parallel, and precisely uniform. The orifice plate must also be compatible with the ink compositions used, and must be resistant to erosion by the ink. In addition, the regions around the orifices should be sufficiently open to provide for cleaning ink and dirt deposits from the orifices for maintaining proper operation.

One method for producing such an orifice plate is to etch a suitable substrate, which can be done using well-known photoresist techniques. A difficulty with this method, however, is the requirement of virtually absolute uniformity among all the orifices. When a metallic substrate is etched, for example, great care must be taken to achieve the required accuracy.

Some success in the forming of etched orifice plates has been achieved through the use of selective etching of crystalline substrates along particular planes of the crystal. See, for example, U.S. Pat. Nos. 3,921,916, 3,949,410, and 4,007,464. However, the preferred crystalline material (silicon) does not have as much resistance to erosion by the ink as would be desirable, sometimes requiring an erosion resistant coating as shown in several of these references. Such crystalline orifice plates are thus expensive (being made of a single crystal), difficult and expensive to fabricate, and not always of the desired strength or durability.

A need thus remains for an orifice plate which meets the above noted requirements in an inexpensive, easily fabricated, strong, durable, and reliable configuration.

SUMMARY OF THE INVENTION

Briefly, the present invention meets the above-noted needs while overcoming the difficulties of prior art configurations with a solid, homogeneous orifice plate formed of a single material. In the preferred embodiment the orifice plate is formed of nickel metal, which is compatible with inks used in jet drop recorders, and is resistant to erosion. The method for fabricating the orifice plate provides extreme uniformity among the orifices. Further, recesses and cavities on both sides of the orifice are provided which are open and accessible. There are no enclosed cavities so that the orifice plate and orifices are easy to keep clean for proper operation.

The orifice plate itself is formed entirely by plating techniques. No drilling or etching is involved. This provides good control of the various orifice and plate dimensions throughout the fabrication thereof.

In practice, the orifice plates may conveniently be formed in pairs. A suitable flat substrate (such as a sheet of stainless steel) is coated on both sides with a suitable photoresist material. The photoresist is then exposed through suitable masks and developed so that there are round, preferably cylindrical, photoresist peg areas on each side of the substrate corresponding to the orifices which are to be formed. The orifice plate material, such as nickel, is then plated (preferably by electroplating) onto the substrate. Plating continues until the nickel has grown up beyond the height of the pegs, at which time the nickel begins to plate inwardly over the edges of each peg as well as upwardly from the substrate. This progressively covers the edges of the pegs with the nickel, and is continued until orifices of exactly the desired size are formed over the photoresist pegs on each side of the substrate. The volumes occupied by the resist pegs will eventually be orifice recesses in the final orifice plate.

Next a larger and much thicker plug is formed over each orifice on the sides of the orifices opposite the pegs (that is, opposite the recesses). The plugs are also formed of photoresist material, by suitable coating, masking, and developing procedures. Each plug is preferably cylindrical so that the cavity which it ultimately will form will likewise be cylindrical. The substrate is then again plated so that the nickel builds up to the top level of the resist plugs on each side of the substrate.

At this point an orifice plate has been fabricated on each side of the substrate. The photoresist and the substrate are removed by conventional techniques (such as chemically dissolving the photoresist and mechanically peeling the orifice plates from the substrate), yielding two solid, homogeneous, metallic orifice plates, one from each side of the substrate.

It is therefore an object of the present invention to provide a solid orifice plate for use in a jet drop recorder; an orifice plate formed throughout of a single homogeneous material such as nickel; an orifice plate which may be formed by plating the material around resist pegs on a substrate to form orifices around the pegs, then forming resist plugs over the orifices and further plating the orifice plate material around the sides of the plugs to thicken the orifice plate, following which the resist and substrate are removed; which provides such an orifice plate in an inexpensive yet highly reliable configuration in which the orifices are uniform and highly resistant to erosion, easy to clean, and in which the orifice plate may readily be fabricated in the thickness necessary to provide sufficient strength for the application at hand.

Other objects and advantages of the invention will be apparent from the following description, the accompanying drawings and the appended claims.

DESCRIPTION OF THE PREFERRED EMBODIMENT

Figure 1:
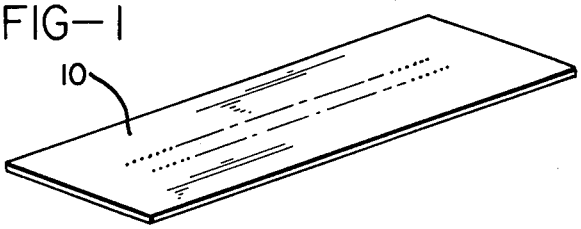
FIG. 1 shows a solid orifice plate fabricated according to the present invention.
Figure 2:
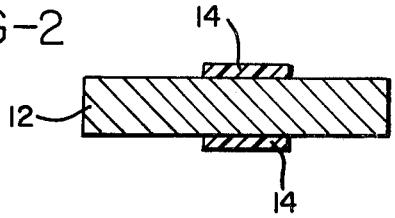
FIG. 2 shows a portion of a substrate having resist pegs formed thereon as the first step in the preparation of the orifice plate shown in FIG. 1.

The orifice plate 10 (FIG. 1) is formed by first preparing a suitable substrate 12, such as a plate of stainless steel. The stainless steel plate may be as thick as necessary to be sure it will remain flat and true. This is then coated in known fashion by a photoresist material, which is exposed through suitable masks to form a series of cylindrical pegs 14 on each side of the substrate 12. The resist pegs 14 remain on the substrate 12 after the photoresist is developed and the unexposed resist washed away.

Figure 3:
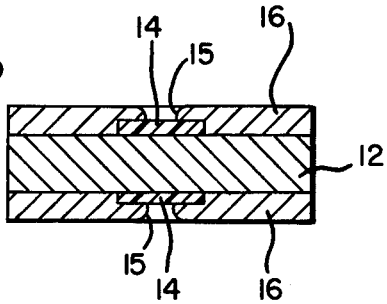
FIG. 3 illustrates the next step in the fabrication, in which the orifice plate material has been plated onto the substrate to form the orifice plate nozzles.

The substrate 12 is then plated with nickel 16, as illustrated in FIG. 3. Nickel is preferred since it provides adequate strength and is compatible with current ink compositions used in jet drop recorders, reducing erosion of the orifices to a minimum. The plating may be done, for example, by electroplating the substrate 12 in a suitable solution. During such an electroplating process, the nickel 16 is formed on the areas of the substrate which are conductive. Thus, no nickel plates onto the pegs 14. As the nickel plate 16 reaches and plates above the tops of the pegs 14, the plating begins to creep inwardly across the top edges of the pegs, since the nickel around the edges of the pegs is conductive, inducing plating in a radial direction across the tops of the pegs as well as in the outward direction away from the substrate. The plating is continued until the openings over the pegs 14 have been closed by the nickel to the exact diameters desired for forming and defining orifices 15 for the orifice plate 10.

Figure 4:
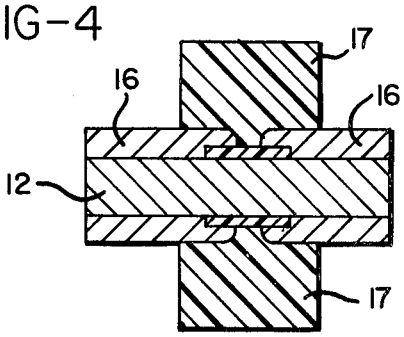
FIG. 4 shows the step following FIG. 3, in which resist plugs have been formed over the orifices.
Figure 5:
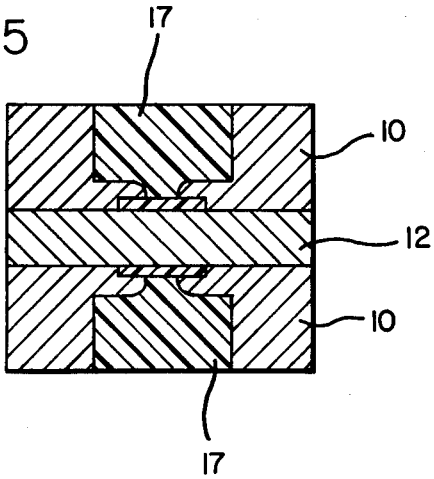
FIG. 5 illustrates the step following FIG. 4, in which additional material has been plated to the tops of the plugs.
Figure 6:
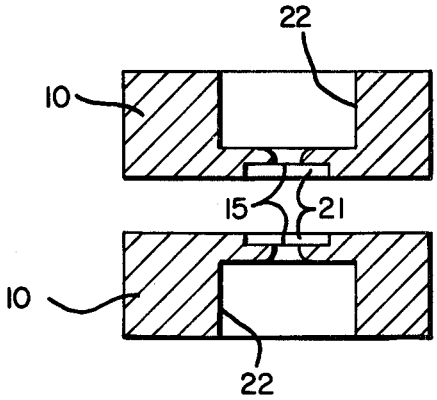
FIG. 6 illustrates the two completed orifice plates following removal of the substrate and resist in FIG. 5.
Figure 7:
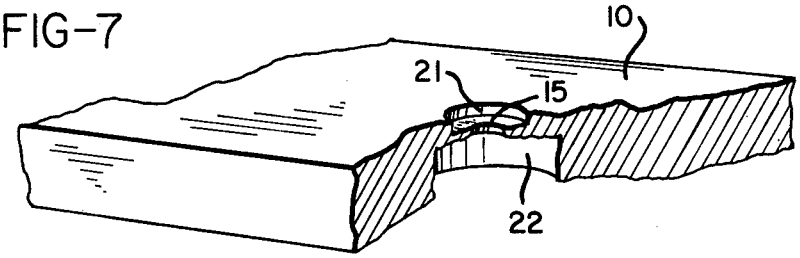
FIG. 7 is a fragmentary, partially broken away view of the orifice plate showing details of one of the orifices.

Next the orifice plate is thickened to provide the desired physical strength for use in a jet drop recorder. As will be seen, when the orifice plate is so thickened, substantially cylindrical cavities are formed opposite each orifice 15 to provide open access to the orifices for cleaning and for reducing the likelihood that deposits will accumulate. FIGS. 4 and 5 illustrate these steps. First a cylindrical plug 17 of a greater diameter and a substantially greater thickness than the pegs 14 is formed on the side of each orifice 15 opposite the pegs 14, and substantially in line therewith (FIG. 4). Plating of the nickel is then resumed up the sides of the plugs 17 to the outer surface of the plugs.

Next the resist and substrate are removed. The nickel material which remains from each side of the substrate is an orifice plate. The areas previously occupied by each of the pegs 14 define orifice recesses 21 and the regions occupied by the plugs 17 are now cylindrical cavities 22, with the orifices 15 disposed between their respective recesses and cavities. The orifice plate itself is of a thickness to provide the strength necessary for use in the jet drop recorder. The recesses and cavities 21 and 22 provide open and easy access to the orifices 15 for cleaning, and for reducing the likelihood that dirt or other deposits will accumulate.

In a typical embodiment, when the nickel is first plated (FIG. 3), it is plated to a thickness of approximately 1.5 mils. The cylindrical plugs 17 (FIG. 4) are approximately 10 mils. in diameter and 6 mils. thick, so that the final orifice plate is 7.5 mils. thick.

As may be seen, therefore, the present invention has numerous advantages. It is formed of relatively inexpensive material by a relatively inexpensive and uncomplicated procedure. The results are uniform, and such uniformity is easier to obtain than with etching or drilling. In contrast to crystal orifice plates, the present invention starts with an inexpensive stainless steel substrate rather than an expensive, fragile, single crystal which must be prepared with a specific orientation. Standard photoresist techniques are used, followed by standard, inexpensive electroplating of the desired metal onto the substrate. The plugs 17 may be of any suitable thickness to provide the strength necessary in the orifice plate 10. The final orifice plates are extremely uniform, compatible with the inks used in the jet drop recorder, and the orifices are readily accessible for cleaning. In fact, due to the open access to the orifices, they can be given protective coatings if, for example, a particular ink might be used under circumstances where such a coating would be desirable.

While the method and article herein described constitute preferred embodiments of the invention, it is to be understood that the invention is not limited thereto, and that changes may be made therein without departing from the scope of the invention.

What is claimed is:

1. A method of producing a solid orifice plate adapted for use in a jet drop recorder, comprising:

(a) forming a resist peg on a substrate to define an orifice recess, (b) plating the substrate around the sides of the peg to form the orifice recess and over the peg to form an orifice smaller than the recess over the peg, (c) forming a resist plug larger than the orifice over the orifice to define a cavity on the side of the orifice opposite the recess, (d) plating the substrate again around the sides of the plug to thicken the orifice plate and to form the cavity, and (e) removing the resist and substrate to leave an orifice plate having an orifice disposed between the recess and the cavity.

2. The method of claim 1 wherein both said plating steps further comprise plating the substrate with the same material for forming a homogeneous orifice plate.

3. The method of claim 2 wherein said plating steps further comprise plating with nickel for forming a solid nickel orifice plate.

4. The method of claim 1 wherein said first plating step further comprises plating inwardly across the top edges of the peg to form the orifice.

5. The method of claim 1 wherein said forming steps further comprise forming a substantially cylindrical peg and a substantially cylindrical plug for forming a substantially cylindrical recess and a substantially cylindrical cavity.

6. A solid, homogeneous, metallic orifice plate produced by the method of claim 1.

7. A method for producing a solid nickel orifice plate adapted for use in a jet drop recorder, comprising:

(a) forming a substantially cylindrical resist peg on a substrate to define a substantially cylindrical orifice recess, (b) plating the substrate with nickel around the sides of the peg and inwardly across the top edges thereof to form the orifice recess and to form an orifice smaller than the recess over the peg, (c) forming a substantially cylindrical resist plug over the orifice to define a substantially cylindrical cavity on the side of the orifice opposite the recess, the plug and cavity being larger than the peg and recess, (d) plating the substrate again with nickel around the sides of the plug to thicken the orifice plate and to form the cavity, and (e) removing the resist and substrate to leave an orifice plate having an orifice disposed between the recess and the cavity.

* * * * *